US009723424B2

(12) United States Patent
Spille

(10) Patent No.: US 9,723,424 B2
(45) Date of Patent: Aug. 1, 2017

(54) MAKING AVAILABLE A SOUND SIGNAL FOR HIGHER ORDER AMBISONICS SIGNALS

(71) Applicant: Dolby Laboratories Licensing Corporation, San Francisco, CA (US)

(72) Inventor: Jens Spille, Hemmingen (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 120 days.

(21) Appl. No.: 14/442,481

(22) PCT Filed: Oct. 31, 2013

(86) PCT No.: PCT/EP2013/072821
§ 371 (c)(1),
(2) Date: May 13, 2015

(87) PCT Pub. No.: WO2014/075934
PCT Pub. Date: May 22, 2014

(65) Prior Publication Data

US 2016/0277866 A1 Sep. 22, 2016

(30) Foreign Application Priority Data

Nov. 14, 2012 (EP) ..... 12306414

(51) Int. Cl.
*H04S 3/02* (2006.01)
*G10L 19/20* (2013.01)

(52) U.S. Cl.
CPC ..... *H04S 3/02* (2013.01); *G10L 19/20* (2013.01); *H04S 2400/15* (2013.01); *H04S 2420/11* (2013.01)

(58) Field of Classification Search
None
See application file for complete search history.

(56) References Cited

U.S. PATENT DOCUMENTS 4,151,369 A 4/1979 Gerzon
5,757,927 A 5/1998 Gerzon et al.
(Continued)

FOREIGN PATENT DOCUMENTS

EP 2451196 5/2012
WO WO2012059385 5/2012
WO EP2469741 6/2012

OTHER PUBLICATIONS

Ellen, R., "Ambisonics: The Surround Alternative", Third Annual SUrround Conference and Technology Showcase, Dec. 7, 2001, pp. 1-4.
(Continued)

*Primary Examiner* — Paul Huber

(57) ABSTRACT

Audio signals are recorded with microphones receiving acoustic information from one or more directions. The corresponding audio signals can be pre-listened to in production studios. However, Higher Order Ambisonics (HOA) audio signals are matrixed in such a way that the matrixing prevents listening to the matrixed sound signals without dematrixing the matrixed sound signals. For enabling a sound engineer to listen to such a matrixed signal without full HOA decoding, an informative audio signal is added together with related side information data at encoding side to a selected part of the matrixed signal. This informative audio signal is removed before the inverse matrixing process at decoding side.

14 Claims, 2 Drawing Sheets

(56) References Cited

U.S. PATENT DOCUMENTS

2011/0305344 A1* 12/2011 Sole ..... G10L 19/008
381/22
2013/0216070 A1* 8/2013 Keiler ..... G10L 19/008
381/300

OTHER PUBLICATIONS

Search Report Dated Jan. 13, 2014.

* cited by examiner

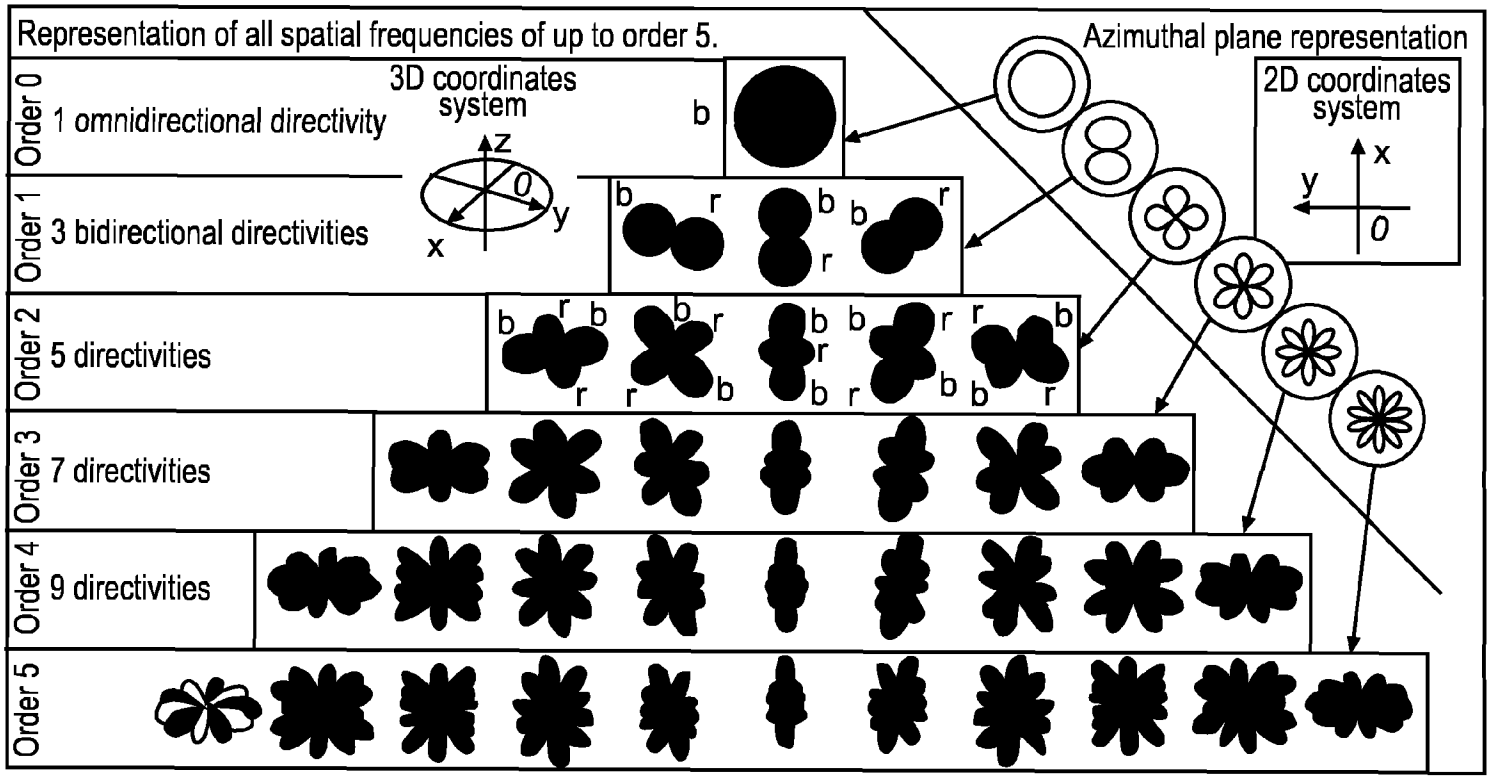
Fig. 2
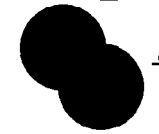
Fig. 5
Fig. 4
Fig. 3

MAKING AVAILABLE A SOUND SIGNAL FOR HIGHER ORDER AMBISONICS SIGNALS

This application claims the benefit, under 35 U.S.C. §365 of International Application PCT/EP2013/072821, filed Oct. 31, 2013, which was published in accordance with PCT Article 21(2) on May 22, 2014 in English and which claims the benefit of European patent application No. 12306414.9, filed Nov. 14, 2012.

The invention relates to a method and to an apparatus for facilitating making available a sound signal for HOA signals.

BACKGROUND

Audio signals are recorded with microphones receiving acoustic information from one or more directions. The corresponding audio signals can be pre-listened to in production studios. Some audio signals are matrixed before they reach a mixer unit or during the mixing process. Matrixed audio signals are still 'normal' audio signals and can be processed using a mixer unit.

INVENTION

There are two kinds of matrix encodings:

a) Some matrix encodings, like Lt-Rt, are matrixing input signals together and the output is still a signal which can be listened to.

b) Other matrix encodings, like Higher Order Ambisonics HOA, are matrixing input signals together but the output signal is not naturally designed to be listened to.

A problem to be solved by the invention is to process category b) signals such that a sound engineer can get useful information to be listened to without a complete HOA decoding. The present invention relates to methods to solve this problem and apparatuses that utilize these methods.

For enabling a sound engineer to listen to such a matrixed signal, an 'informative audio signal' is added at encoding side to the matrixed encoding output. This 'informative audio signal' is removed before, or during, the inverse matrixing process at decoding side.

In principle, the inventive encoding method is suited for facilitating the availability at least one sound signal that is combined with a Higher Order Ambisonics signal denoted HOA signal, said method including the steps:

- splitting said HOA signal into a selected signal part and a remaining signal part;
- extracting from said remaining signal part at least one partial signal;
- combining said at least one partial signal with said selected signal part so as to form an amended selected signal part, from which said at least one partial signal can be made available;
- output of said remaining signal part, said amended selected signal part, and side information data which is suitable for removing at a decoding side said at least one partial signal from said amended selected signal part so as to get said selected signal part, and for merging said remaining signal part and said selected signal part and for decoding said HOA signal.

In principle the inventive encoding apparatus is suited for facilitating making available at least one sound signal that is combined with a Higher Order Ambisonics signal denoted HOA signal, said apparatus including:

- means being adapted for splitting said HOA signal into a selected signal part and a remaining signal part;
- means being adapted for extracting from said remaining signal part at least one partial signal;
- means being adapted for combining said at least one partial signal with said selected signal part so as to form an amended selected signal part, from which said at least one partial signal can be made available, wherein said apparatus outputs said remaining signal part, said amended selected signal part, and side information data which is suitable for removing at a decoding side said at least one partial signal from said amended selected signal part so as to get said selected signal part, and for merging said remaining signal part and said selected signal part and for decoding said HOA signal.

In principle, the inventive decoding method is suited for decoding an amended HOA signal which was processed according to the above encoding method, said decoding method including the steps:

- based on said side information data, extracting from said remaining signal part said at least one partial signal;
- removing said at least one partial signal from said amended selected signal part so as to get said selected signal part;
- merging said selected signal part and said remaining signal part so as to get said HOA signal;
- decoding said HOA signal.

In principle the inventive decoding apparatus is suited for decoding an amended HOA signal which was processed according to the above encoding method, said apparatus including:

- means being adapted for extracting, based on said side information data, from said remaining signal part said at least one partial signal;
- means being adapted for removing said at least one partial signal from said amended selected signal part so as to get said selected signal part;
- means being adapted for merging said selected signal part and said remaining signal part so as to get said HOA signal;
- means being adapted for decoding said HOA signal.

Advantageous additional embodiments of the invention are disclosed in the respective dependent claims.

DRAWINGS

Exemplary embodiments of the invention are described with reference to the accompanying drawings, which show in:

FIG. 2 illustrates a graphical representation of a spherical harmonics representation of spatial frequencies;

FIG. 3 illustrates a detailed illustration of a first part of FIG. 1;

FIG. 4 illustrates a detailed illustration of a second part of FIG. 1;

FIG. 5 illustrates a detailed illustration of a third part of FIG. 1.

EXEMPLARY EMBODIMENTS

Figure 1:
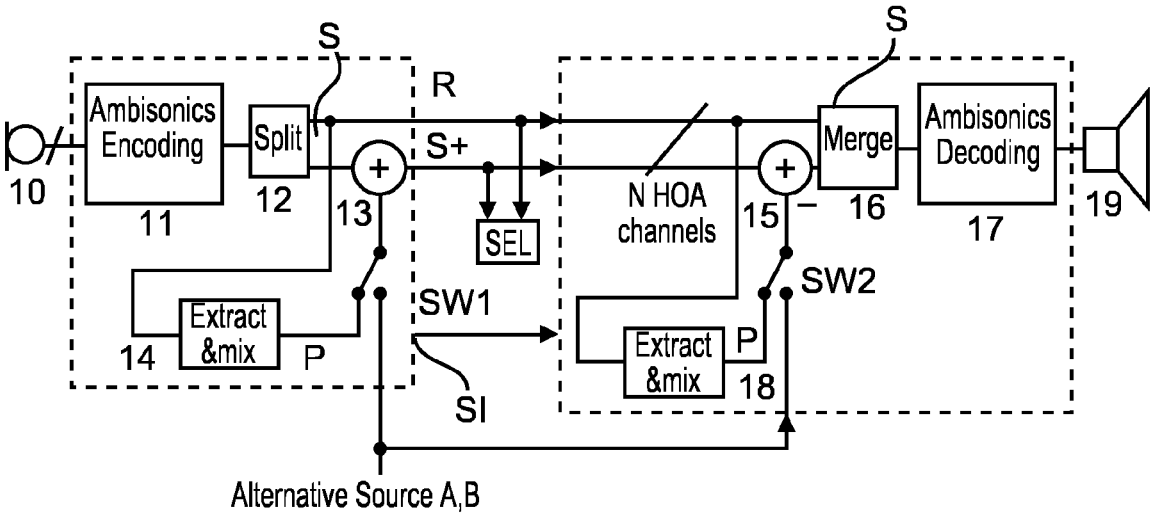
FIG. 1 illustrates a block diagram for the inventive processing.

A Higher Order Ambisonics (HOA) format signal is a matrix encoded signal, consisting of N HOA channels. The input signal from a microphone array is multiplied with a spherical harmonic function, cf. WO 2012/059385 A1, EP 2469741 A1 and EP 2451196 A1.

FIG. 2 depicts a spherical harmonics representation of spatial frequencies, with b=blue for positive spatial frequency lobes and r=red for negative spatial frequency lobes. This figure is disclosed in colour at http://trinnov.com/downloads-type/downloads/, White Paper HSR Recording, 5.0 Sound recording in High Spatial Resolution, FIG. 4-*n*.

The first partial signal of order zero shown in FIG. 3, which is also denoted 'W', contains all input signals from all directions, so the sound engineer can listen to it and get all information.

The 2nd to 4th partial signals from the first order (also called 'X', 'Y', 'Z') shown in FIG. 4 contain signals from left-right, top-bottom and front-rear.

The higher orders (an example is shown in FIG. 5) contain only signals from specific directions with more or less sharp beams.

In particular channels related to higher orders can contain only a very small amount of information if there were no sound sources from those directions during the recording. In addition, some frequency filtering can be included in the encoding process, which can further reduce the amount of information in higher order channels.

According to the invention, in order to facilitate checking or identification of such an HOA matrix encoded signal by a sound engineer, at least one of the HOA signals or channels (e.g. 'X', 'Y' and/or 'Z') is extracted from the HOA matrix encoded signal and is added to, or combined with, e.g. the zero order 'W' signal, resulting in e.g. W+X, W+Y or W+Z, so that in total still N channels are present.

As an alternative, another signal or signals preferably related to the content of the matrixed audio signal, and known (e.g. by transmission within side information data) to the decoder side, is added or combined to Ambisonics channels like 'W', 'X', 'Y', 'Z', . . . , e.g. one or more existing 'informative' audio channels like 'A', 'B', . . . , as level-reduced zero order type signals for the zero order channel and/or as first order type signals for first order channels. This can be a voice saying "this is channel X", or any other easy-to-listen-to signal. I.e., stored or transmitted is a matrixed audio signal comprising e.g. W+A, X+A, Y+B, . . . , which in total still has N channels.

In addition, side information data are added to the signal to be transmitted or stored, in order to indicate which signal was added in which level to the original HOA signal. The formatting of that side information data is up to the specification of a related system. At least data regarding a transmission channel index and the level or levels of the additional signal or signals and possibly of the matrixed signal as such are transmitted or stored, and in the above alternative, the 'informative' audio channel signal or signals 'A', 'B', . . . .

At receiver or decoding side, prior to the Ambisonics dematrixing or decoding, the additional audio signal or signals, respectively, are subtracted or removed from the received signal using the side information data, in order to get back the true or original Ambisonics channel signals, e.g. W'=W−X, W'=W−Y or W'W−Z.

In the above-described case of additional e.g. 'A', 'B' signals, in order to get back the true or original Ambisonics channel signals, for example W'=W−A, X'=X−A, Y'=Y−B is performed.

As an alternative, a fixed and well-defined insertion and removal process can be specified for a corresponding system.

In FIG. 1, multiple microphone signals 10 from a microphone array pass through an Ambisonics encoding 11 (i.e. an Ambisonics matrixing resulting in N channels) to a splitting step or stage 12. In step/stage 12 a selected matrixed signal part S (e.g. 'W') of the Ambisonics signal is separated from the remaining matrixed signal part R. From the remaining matrixed signal part R one or more of the Ambisonics channels (e.g. 'X') are extracted in an extracting&mixing step or stage 14, and the resulting output signal P is combined in a combiner 13 with the selected matrixed signal part S, resulting in amended selected matrixed signal part S+(e.g. S+=W+X), which still represents N channels. The remaining matrixed signal part R and the amended selected matrixed signal part S+ are transmitted to the decoder side together with related side information data SI, or are stored. A mixing in step/stage 14 can be applied in case there is more than one channel signal to be added.

The amended selected matrixed signal part S+ can be evaluated in a sound engineer listening step or stage SEL. In addition, signal R can be fed to step/stage SEL. Using step/stage SEL, the sound engineer can listen to W+X (or to e.g. W+A in the alternative embodiment), i.e. to signal S+. If, instead of S+=W+X, S+=A+X for example, or if S=X and P=W, step/stage SEL can take W from signal R and make W available to the sound engineer. The advantage is that step/stage SEL needs not carrying out a complete HOA decoding.

At decoding side, based on the received side information data SI, from the remaining matrixed signal part R of the Ambisonics signal the one or more additional Ambisonics channels selected in step/stage 14 at encoder side are extracted in an extracting&mixing step or stage 18, and are removed in a subtractor or remover 15 from the amended selected matrixed signal part S+. The corresponding remaining selected matrixed signal part S and the remaining matrixed signal part R of the Ambisonics signal are merged in a merging step or stage 16, then representing the original HOA signal, and the merged signals are Ambisonics dematrixed or decoded in an Ambisonics decoding 17, and can be output to a suitable loudspeaker arrangement 19.

In the embodiment where signals like 'A', 'B' are used as additional signals, these signals are fed via switch SW1 to combiner 13, instead of the output signal from step/stage 14. At decoder side, the signals 'A', 'B' are fed via switch SW2 to remover 15, instead of the output signal from step/stage 18.

In a further embodiment, the original HOA signal level can be reduced in order to avoid overload after adding another signal. E.g. the peak level of the sum (X+A) should be smaller than the maximum limit.

Instead of zero order signal 'W' type, the added signal can be a combination of different-type signals, like the zero order signal 'W' plus the first signal 'X' from the first order, which would produce a signal coming from the left or the right.

Instead of using a type of one of the HOA partial signals, another signal type known to the decoder could be used, like one of the original microphone signals.

As already mentioned above, instead of a real audio signal some earcons, a brief distinctive sound, or brief announcements like "this is channel X" could be used.

The invention claimed is:

1. A method for processing for listening at least one sound signal that is combined with a Higher Order Ambisonics signal denoted HOA signal, said method comprising:

splitting said HOA signal into a selected signal part and a remaining signal part;

extracting from said remaining signal part at least one partial signal;

combining said at least one partial signal with said selected signal part so as to form an amended selected signal part;

outputting the amended selected signal part for listening;

outputting of said remaining signal part, said amended selected signal part, and side information data, wherein the side information is related to said at least one partial signal, the side information further related to merging said remaining signal part and said selected signal part.

2. The method according to claim 1 wherein, instead of extracting from said remaining signal part said at least one partial signal and combining said at least one partial signal with said selected signal part so as to form an amended selected signal part, one or more separate signals are combined with said selected signal part so as to form an amended selected signal part.

3. The method according to claim 1 wherein, in order to avoid overload following said combining, the original signal level of said HOA signal is reduced.

4. The method according to claim 1, wherein said partial or additional, respectively, signal is one of original microphone signals, from which microphone signals said HOA signal was generated.

5. The method according to claim 1, wherein said partial signal is a combination of HOA zero order type signal and HOA first order type signal.

6. A method for decoding an amended HOA signal which was processed according to the method of claim 1, said decoding method comprising:

based on said side information data, extracting from said remaining signal part said at least one partial signal;

removing said at least one partial signal from said amended selected signal part so as to get said selected signal part;

merging said selected signal part and said remaining signal part so as to get said HOA signal;

decoding said HOA signal.

7. The method according to claim 6 wherein, instead of extracting from said remaining signal part said at least one partial signal and removing said at least one partial signal from said amended selected signal part so as to get said selected signal part, said one or more separate signals are removed from said amended selected signal part so as to get said selected signal part.

8. An apparatus for processing for listening at least one sound signal that is combined with a Higher Order Ambisonics signal denoted HOA signal, said apparatus comprising:

a splitter configured to split said HOA signal into a selected signal part and a remaining signal part;

an extractor configured to extract from said remaining signal part at least one partial signal;

a combiner configured to combine said at least one partial signal with said selected signal part so as to form an amended selected signal part wherein the apparatus is configured to output the amended selected signal part for listening, and the apparatus is further configured to output said remaining signal part, said amended selected signal part, and side information data, wherein the side information is related to said at least one partial signal and to merging said remaining signal part and said selected signal part.

9. The apparatus according to claim 8 wherein, instead of extracting from said remaining signal part said at least one partial signal and combining said at least one partial signal with said selected signal part so as to form an amended selected signal part, one or more separate signals are combined with said selected signal part so as to form an amended selected signal part.

10. The apparatus according to claim 8 wherein, in order to avoid overload following said combining, the original signal level of said HOA signal is reduced.

11. The apparatus according to claim 8, wherein said partial or additional, respectively, signal is one of original microphone signals, from which microphone signals said HOA signal was generated.

12. The apparatus according to claim 8, wherein said partial signal is a combination of HOA zero order type signal and HOA first order type signal.

13. An apparatus for decoding an amended HOA signal which was processed according to the method of claim 1, said apparatus comprising:

an extractor which extracts, based on said side information data, from said remaining signal part said at least one partial signal;

a remover which removes said at least one partial signal from said amended selected signal part so as to get said selected signal part;

a merger which merges said selected signal part and said remaining signal part so as to get said HOA signal;

a decoder for said HOA signal.

14. The apparatus according to claim 13 wherein, instead of extracting from said remaining signal part said at least one partial signal and removing said at least one partial signal from said amended selected signal part so as to get said selected signal part, said one or more separate signals are removed from said amended selected signal part so as to get said selected signal part.

* * * * *